US005635141A

United States Patent [19]

Fischer

[11] Patent Number: 5,635,141

[45] Date of Patent: Jun. 3, 1997

[54] RADIAL FLOW EXHAUST CATALYTIC CONVERTER

[75] Inventor: Daniel M. Fischer, Troy, Mich.

[73] Assignee: E. I. Du Pont de Nemours and Company, Wilmington, Del.

[21] Appl. No.: 553,135

[22] Filed: Nov. 7, 1995

Related U.S. Application Data

[63] Continuation of Ser. No. 295,786, filed as PCT/US92/02180 Mar. 17, 1992, published as WO93/19289 Sep. 30, 1993 abandoned.

[51] Int. Cl.[6] ..... B01D 50/00; B01D 53/34

[52] U.S. Cl. ..... 422/171; 422/180; 60/287; 60/299

[58] Field of Search ..... 422/170, 171, 422/180; 60/287, 299

[56] References Cited

U.S. PATENT DOCUMENTS

| | | | |
|---|---|---|---|
| 3,972,685 | 8/1976 | Hanaoka | 23/288 |
| 3,989,471 | 11/1976 | Nowak | 422/171 |
| 4,008,570 | 2/1977 | Harada | 60/299 |
| 4,094,644 | 6/1978 | Wagner | 422/181 |
| 4,175,107 | 11/1979 | Iwaoka et al. | 422/114 |
| 4,797,263 | 1/1989 | Oza | 422/176 |
| 5,174,969 | 12/1992 | Fischer et al. | 422/180 |

FOREIGN PATENT DOCUMENTS

| | | |
|---|---|---|
| 417412 | 6/1990 | European Pat. Off. . |
| 1388637 | 3/1975 | United Kingdom . |
| 2220150 | 4/1990 | United Kingdom . |

*Primary Examiner*—Nina Bhat
*Attorney, Agent, or Firm*—Rodney B. Carroll

[57] ABSTRACT

An auxiliary catalytic converter (11) for treating exhaust gas pollutants from an internal combustion engine during warm-up comprises a housing (13) which defines an exhaust gas receiving chamber (15), an exhaust gas inlet (17) in one end of the housing and an exhaust gas outlet (19) at the other end of the housing, a hollow catalyst structure (23) having discrete channels or pores secured in the chamber spaced from the walls of the housing and aligned axially providing a passage (25) between the outer surface of the catalyst structure and the wall and an axial channel (27) in communication with the gas inlet and gas outlet, and valve means (41) adapted to be opened and closed in response to a predetermined condition, the valve means when in a closed position restraining exhaust gas flow in the axial channel causing the gas to flow radially through the catalyst structure into the passage and when in an open position permitting essentially unimpeded flow of gas from the gas inlet through the axial channel to the gas outlet.

6 Claims, 2 Drawing Sheets

RADIAL FLOW EXHAUST CATALYTIC CONVERTER

This is a continuation of application Ser. No. 08/295,786 filed Sep. 13, 1994, now abandoned which is a 371 of PCT/US92/02180, filed Mar. 17, 1992 published as WO93/19289 Sep. 30, 1993.

FIELD OF THE INVENTION

This invention relates to catalytic converters for controlling emission levels from internal combustion engines. More particularly, the invention relates to an auxiliary catalytic converter for controlling emissions from an internal combustion engine during the period of engine warm-up.

BACKGROUND OF THE INVENTION

The greatest concentration of atmospheric contaminants from the exhaust of an internal combustion engine occurs immediately following start-up of the engine. While catalytic converters are required in the exhaust system, such converters are essentially ineffective in controlling pollutants until they are heated to elevated temperatures by the hot exhaust gases, from the engine.

Efforts have been made to control this problem using so called warm-up or "pup converters" which are positioned near the exhaust manifold in advance of a main, under the floor, converter. In some embodiments these converters are heated electrically. Generally the exhaust gases are forced through honeycombed structures the surface of which is coated with a catalyst. While these converters do reduce pollutant emissions following start-up, they are power and fuel consumers. The flow of exhaust gases is impeded throughout the time the engine is operating. In addition to this inefficiency, catalyst in the converter continues to be deactivated as long as the engine is running.

SUMMARY OF THE INVENTION

In accordance with this invention there is provided a unitary auxiliary catalytic converter for an internal combustion engine which achieves rapid catalytic activity without substantial operating pressure and power losses associated with known warm-up converter systems. The system utilizes a radial flow catalyst system which is placed adjacent or as a part of the exhaust manifold at the coition or "Y" where the cylinder exhaust tubes come together.

The converter of this invention comprises a housing defining a gas receiving chamber and has an exhaust gas inlet at one end of the housing adjacent or as a part of the exhaust manifold and an exhaust gas outlet at the other end of the housing. The catalyst comprises a cartridge which has an annular structure and is aligned axially within the housing. The structure has multiple channels or pores through which gases can pass from an internal to an external surface. The cartridge is aligned with the walls of the housing thereby providing a passage between the outer surface of the cartridge and the walls or, alternatively, through the channels or pores in the cartridge, and an axial channel extending from adjacent the exhaust gas inlet to an opening in the outlet. Valve means adjacent the gas outlet are adapted to be opened and closed in response to a predetermined condition of the exhaust gas.

In operation the valve is in a closed position restraining exhaust gas flow through the axial channel during start up thereby causing the exhaust gas to flow radially through the catalyst structure and into the annular passage along the outer walls of the housing. After engine ignition has been sustained for a predetermined period and the engine has reached a satisfactory stable condition, the valve opens removing the axial exhaust flow restriction and permitting exhaust gases to flow down the axis and through the cartridge essentially unrestricted. In the open position, little pressure drop occurs in the axial channel, and there is little or no significant catalytic activity. The dimensions of the axial channel, annular passage, inlet and outlet are determined to accommodate pressure drop and flow rate based on the specific requirements for the particular engine involved.

DETAILED DESCRIPTION OF THE INVENTION

Figure 1:
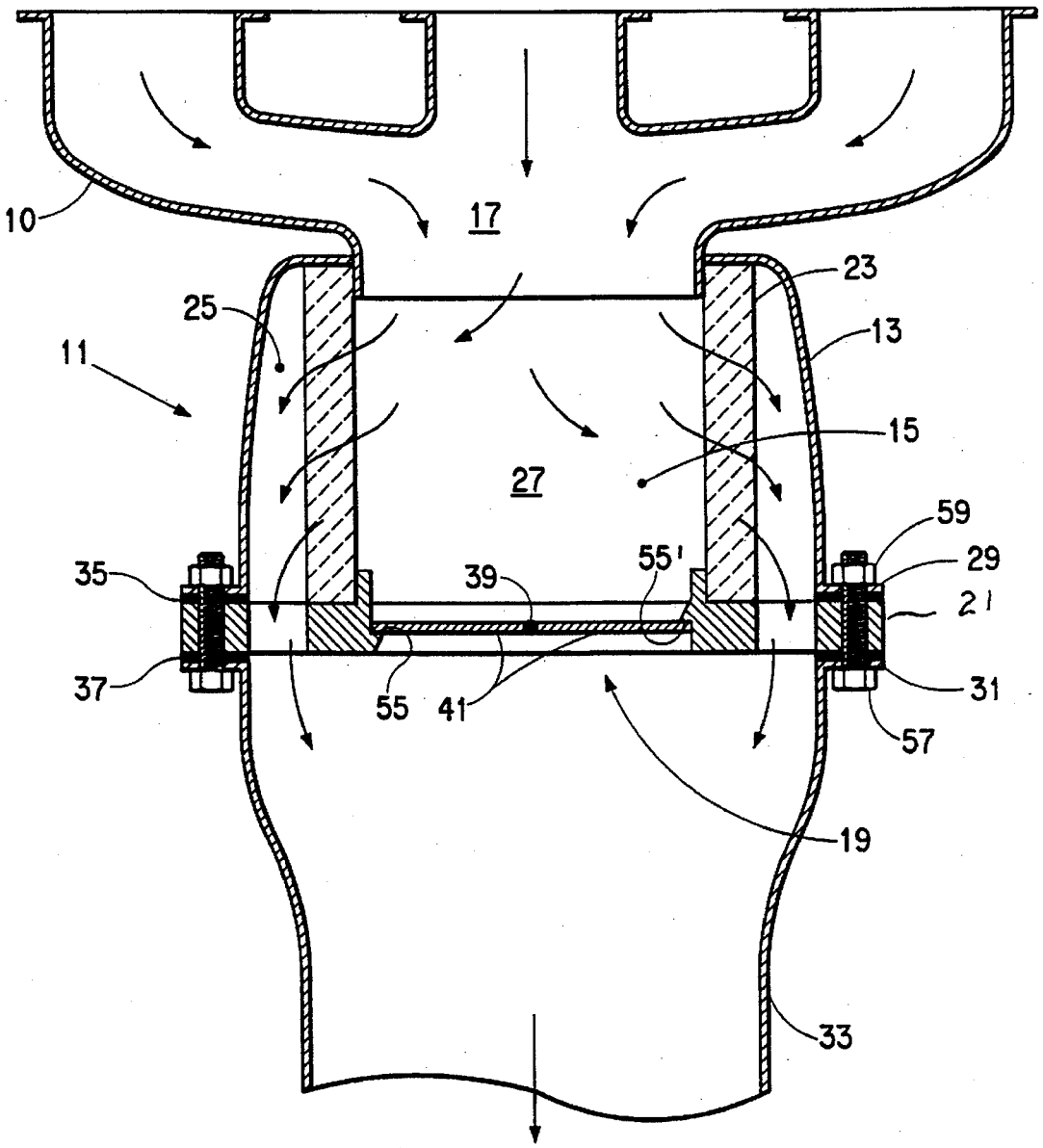
FIG. 1 is a schematic cross-sectional view through a catalytic converter of this invention shown as a portion of an exhaust manifold.

Referring to FIG. 1, catalytic converter 11 is comprised of a housing 13 the walls of which define an exhaust gas receiving chamber 15. Housing 13 may be integral with or form an extension of exhaust manifold 10 of an internal combustion engine, not shown. The engine may be a two or four cycle engine. The chamber has an exhaust gas inlet 17 at one end of the housing and and exhaust gas outlet 19 at the other end of the housing. A catalyst support ring 21 is positioned between the inlet and outlet.

The catalyst structure is preferably in the form of an annular cartridge 23 and is spaced from the walls of the housing and axially aligned in the chamber to provide a passage 25 between the outer surface of the catalyst and the walls and an axial channel 27 in communication with exhaust gas inlet 17 and exhaust gas outlet 19. Alternatively, passage 27 could be provided by channels or pores in the catalyst structure provided sufficient gas flow can be established to outlet 19 through the channels and pores when axial channel 27 is closed.

The catalyst structure has multiple substantially discrete channels and pores throughout. The structure is held in position between housing 13 at inlet 17 and support ring 21 at outlet 19. Gaskets, not shown, may be used at either end of the structure to provide a gas tight seal. The support ring is secured between flanges 29 and 31 of housing 13 and outlet pipe 33 using bolts nuts 59 on 57 and gaskets 35 and 37. Alternatively, the components may be welded in place.

Figure 2:
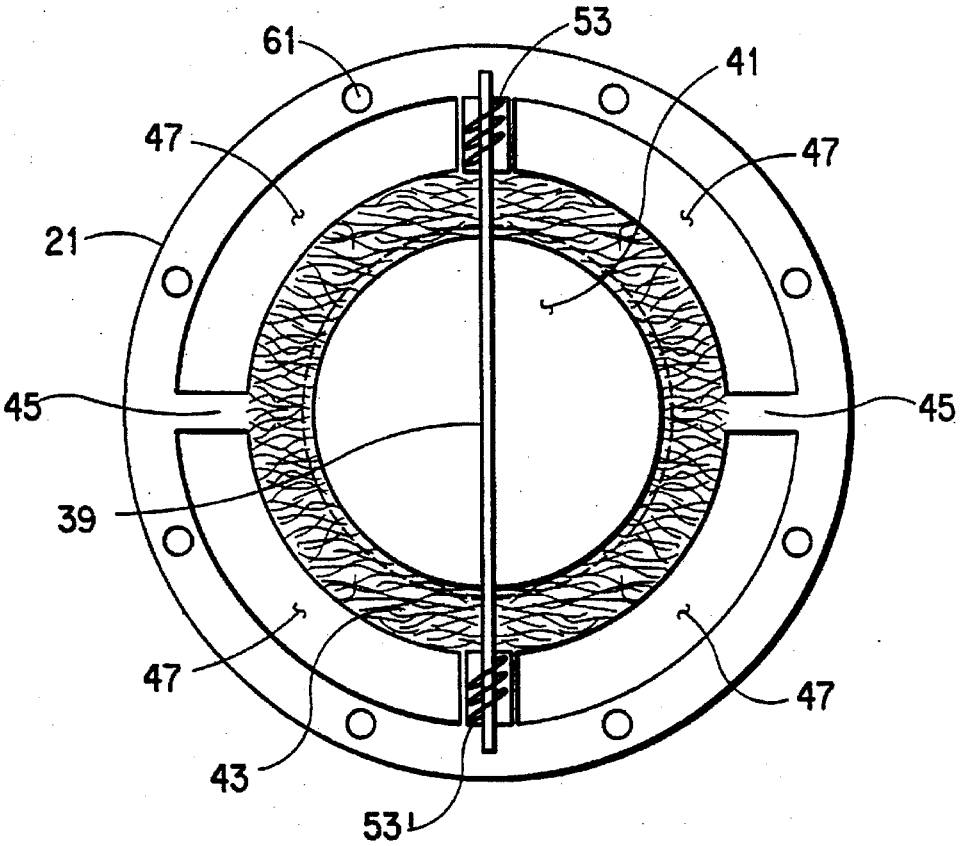
FIG. 2 is a fragmentary, sectional top view of the converter shown in FIG. 1.

Valve 41 is positioned adjacent the base of catalyst support ring 21. A ball valve which when opened provides unrestricted flow of exhaust gases out of chamber 15 through axial channel 27 may be used; however, other known types of valves such as butterfly valves may be used. A butterfly valve arrangement is shown in FIG. 1 and FIG. 2. Valve 41 rests on sealing surfaces 55 and 55' when in the closed position. As shown if FIG. 2 heat sensitive coil springs 53 and 53' retain valve 41 in the closed position when the engine is cold and not running. At start-up, springs 53 and 53' prevent valve from opening as exhaust gas enters chamber 15 and impinges on the face of the valve. As shown in FIG. 1, the gas passes through cartridge 23 to annular passage 25. As the springs are heated to a predetermined temperature by the exhaust gas, the coil increases in length causing valve 41 to rotate to an open position. The valve is aligned in chamber 25 in such a manner so that once it is opened, the exhaust gas flow causes it to self-center in an open position. When the gas flow ceases, coil tension returns the valve to a near closed position. As the coil cools, the valve goes to a fully closed position. This arrangement is simple and particularly cost effective since it captures the kinetic energy of the system and requires no external control components. It is to be noted, however, that various alternatives based on electrical and magnetic applications can be adapted to open and close the valve.

Referring now to FIG. 2, the base 43 of the catalyst cartridge is shown supported on ring 21 by weds 45. Valve 41 which is integral with shaft 39 pivots within the support ring and is shown in the closed position thus blocking the flow of exhaust gases from channel 27. Multiple openings 47 in support ring 21 communicate with annular passage 25 permitting gases to escape through exhaust gas outlet 19. Holes 61 are provided to accept wets 57 in scurring the catalyst structures in the assemble.

The catalyst structure is of the rigid type made from a reticulated annular form comprised of reinforced ceramic fibers. The structure carries a catalyst and provides adequate resistance to both thermal shock and mechanical shock. Suitable structures are disclosed in U.S. Pat. No. 3,949,109, U.S. Pat. No. 3,986,528, U.S. Pat. No. 4,092,194 and U.S. Pat. No. 5,079,064. Other suitable structures such as ceramic and metal foams which provide multiple channels or pores through which gases can pass may be used. Processes for preparing other suitable structures are disclosed in European Patent Applications 91311910.3 and 91311913.7, filed Dec. 20, 1991.

Figure 3:
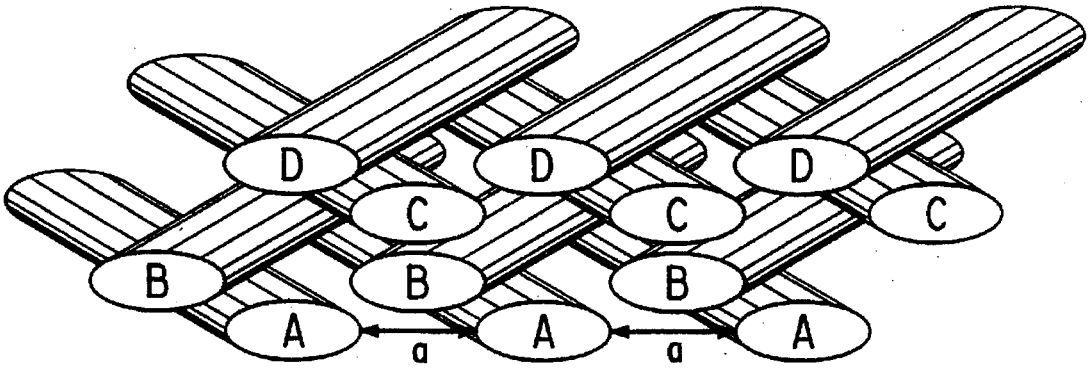
FIG. 3 shows a small segment of a preferred catalyst cartridge structure for use in this invention.

FIG. 3 shows a segment of catalyst cartridge 23. A series of layers of yarn A, B, C and D, which may be repeated many times form a wall for a catalyst cartridge. Separations "a" of the yarns form openings which permit the passage of exhaust gas. Preferably the fibers making up the yarns are substantially alumina generally having diameters in the range of 0.2 to 2.0 mils (0.005 to 0.05 mm). Preparation of refractory oxide fibers and their precursors is disclosed in U.S. Pat. No. 3,808,015 and U.S. Pat. No. 3,853,688. A refractory oxide matrix may be applied to a wound package of the yarns to provide mechanical strength. Reticulated tubes or cartridges useful in this invention exhibit catalytic activity in conversion of exhaust gases to oxidize carbon monoxide, hydrocarbons and/or hydrocarbon residues or reduce nitrogen oxides. This activity may derive from catalytic materials present in the components of the cartridge, i.e. ceramic fibers, ceramic binder or refractory oxide matrix, or by addition of catalysts to the cartridge. The catalyst may be placed on the cartridge by adsorption of a suitable compound of the active component or imbibition of an active material or precursor from a slurry form followed by drying and conversion to the active material.

I claim:

1. A unitary catalytic converter for treating exhaust gas pollutants from an internal combustion engine during engine warm-up comprising a) a housing (13) having walls defining an exhaust gas receiving chamber (15), an exhaust gas inlet (17) at one end of said housing and an exhaust gas outlet (19) at the other end of said housing, b) catalyst holding means (21) disposed in said chamber, c) an annular catalyst structure (23) having multiple channels or pores throughout said structure secured by said holding means, said structure being spaced from the walls of said housing and axially aligned in said chamber thereby providing a passage (25) between the outer surface of said catalyst structure and said walls and an axial channel (27) in communication with said exhaust gas inlet and said gas outlet, and d) valve means (41) adjacent said gas outlet adapted to be opened and closed in response to a predetermined condition, said valve means when in a closed position restraining exhaust gas flow in said axial channel causing said gas to flow radially through said catalyst structure into said passage, and when in an open position permitting essentially unimpeded flow of said gas from said gas inlet through said axial channel to said gas outlet.

2. The catalytic converter of claim 1 wherein said valve is activated by a heat responsive means (53)(53').

3. The catalytic converter of claim 1 wherein said catalyst structure is a reticulated hollow cartridge (23) having multiple channels or pores to permit exhaust gas to flow therethrough.

4. The catalytic converter of claim 3 wherein said valve means includes heat responsive springs (53)(53') which open and close a valve (41).

5. The catalytic converter of claim 4 wherein said catalyst structure (23) is held by compressive force between shoulders on said housing (13) and a support ring (21).

6. A unitary catalytic converter for treating exhaust gas pollutants from an internal combustion engine during engine warm-up comprising a) a housing having walls defining an exhaust gas receiving chamber (15), an exhaust gas inlet (17) at one end of said housing and an exhaust gas outlet (19) at the other end of said housing, b) catalyst holding means (21) disposed in said chamber, c) an annular catalyst structure (23) comprised of a series of layers of yarn providing multiple channels or pores throughout said structure, said structure being axially aligned in said chamber and having an axial channel (27) in communication with said exhaust gas inlet and said gas outlet, said structure being spaced from the walls of said receiving chamber to provide an annular passage 25 for receiving radial flow of exhaust gas which passes through said channels or pores and exits from said passage into gas outlet 19, and d) valve means (41) adjacent said gas outlet adapted to be opened and closed in response to a predetermined condition, said valve means when in a closed position restraining exhaust gas flow in said axial channel and causing said gas to flow through said catalyst structure into said annular passage, and when in an open position permitting essentially unimpeded flow of said gas from said gas inlet through said axial channel to said gas outlet.

* * * * *